US009670915B2

(12) United States Patent
Tanemura

(10) Patent No.: US 9,670,915 B2
(45) Date of Patent: Jun. 6, 2017

(54) SBS PISTON PUMP HOUSING ASSEMBLY

(71) Applicant: Caterpillar Inc., Peoria, IL (US)

(72) Inventor: Hideaki Tanemura, Kanagawa-ken (JP)

(73) Assignee: Caterpillar Inc., Peoria, IL (US)

( * ) Notice: Subject to any disclaimer, the term of this patent is extended or adjusted under 35 U.S.C. 154(b) by 410 days.

(21) Appl. No.: 14/227,701

(22) Filed: Mar. 27, 2014

(65) Prior Publication Data

US 2015/0276058 A1 Oct. 1, 2015

(51) Int. Cl.
*F04B 1/22* (2006.01)
*F16J 10/02* (2006.01)
*F04B 1/20* (2006.01)

(52) U.S. Cl.
CPC ..... *F04B 1/22* (2013.01); *F04B 1/2064* (2013.01)

(58) Field of Classification Search
CPC .. F04B 1/16; F04B 1/22; F04B 1/2064; F16H 61/4165
USPC ..... 60/486
See application file for complete search history.

(56) References Cited

U.S. PATENT DOCUMENTS 3,190,075 A * 6/1965 Ebert ..... F16H 61/44 60/489
4,028,010 A 6/1977 Hopkins
4,365,940 A 12/1982 Hosokawa
4,444,092 A 4/1984 Schott
6,672,843 B1 * 1/2004 Holder ..... F04B 1/22 417/201
7,171,808 B2 * 2/2007 Kadlicko ..... F04B 1/145 60/486
7,334,404 B2 * 2/2008 Sakikawa ..... F04B 1/22 60/435
8,272,315 B1 9/2012 Hauser et al.
9,068,643 B2 * 6/2015 Nelson ..... F16H 57/0424
2014/0023530 A1 1/2014 Frey et al.

FOREIGN PATENT DOCUMENTS

JP 10288148 10/1998
JP 20110964144 3/2011
WO WO-91/19902 12/1991

* cited by examiner

*Primary Examiner* — F. Daniel Lopez
*Assistant Examiner* — Richard Drake
(74) *Attorney, Agent, or Firm* — Miller, Matthias & Hull

(57) ABSTRACT

A housing assembly for a side-by-side (SBS) piston pump may define a pump cavity enclosing first and second piston pumps having parallel longitudinal axes. The housing assembly may include a shroud partially or wholly separating the piston pumps to substantially reduce churning of lubricating fluid flow flowing around the piston pumps and pooling in a fluid intersection area between the piston pumps. The shroud may be a planar shroud plate extending between the piston pumps, or a curved shroud plate between the piston pumps and having sections partially encircling each of the piston pumps. The shroud may alternatively be first and second shroud portions extending inwardly from the cavity walls and directing the lubricating fluid flows the merge in a combined lubricating fluid flow area.

20 Claims, 7 Drawing Sheets

SBS PISTON PUMP HOUSING ASSEMBLY

TECHNICAL FIELD

The present disclosure relates generally to side-by-side (SBS) piston pumps, and more particularly, to an SBS piston pump housing assembly providing improved lubricant flow within the pump cavity to reduce parasitic power loss from churning of lubricating fluids within the housing assembly.

BACKGROUND

Machines such as dozers, loaders, excavators and other types of machinery typically include a hydro-mechanical power transmission system to transfer power, e.g., torque and rotational speed generated by a power source, to one or more connected loads, such as a machine tool or other implement. A major component of these hydro-mechanical power transmission systems is a hydraulic pump. The hydraulic pump or pumps generate pressurized hydraulic fluid that is used to operate the components of the machine.

One type of hydraulic pump is a side-by-side hydraulic piston pump that includes a pump housing defining a gear cavity housing a spur gear set and a pump cavity housing a pair of piston pumps. The piston pumps each include reciprocating pistons arranged within a pump barrel that is operably connected to a rotating shaft. The pistons within each pump extend outwardly from one end of the corresponding pump barrel and impinge on a swash plate. As the barrel and the pistons rotate and the swash plate remains stationary, the pistons reciprocate with a stroke length determined by the orientation of the swash plate, causing hydraulic fluid to be drawn into the pump barrel on the expansion strokes of the pistons and to be discharged from the pump barrel under pressure on the compression strokes. A drive shaft that is operatively coupled to and driven by an engine or other power source of the machine extends into the pump housing, with one of the spur gears, or a drive gear, and one of the piston pumps, or a drive pump, being mounted on the drive shaft for rotation therewith. A driven shaft is mounted for rotation within the pump housing, with the other spur gear of the set, or a driven gear, and the other piston pump, or a driven pump, mounted on the driven shaft for rotation therewith. The driven gear meshes with the drive gear so that the drive pump and the driven pump rotate in opposite directions when the power source drives the drive shaft.

The pump housing is filled with lubricating fluid which surrounds the gear set, the piston pumps and the shafts. The pump cavity surrounds the piston pumps and provides space for the lubricating fluid to flow around and with each pump barrel as the piston pumps are turned by the gears. The drive pump turns in the direction that the drive shaft is driven, while the driven pump turns in the opposite direction. As the pump barrels turn, the surrounding lubricating fluid flows with the rotating pump barrels and pistons within the pump cavity in the direction of rotation of the pump barrels. As the lubricating fluid flowing in opposite directions around the pump barrel and the pistons meets in the area between the piston pumps, the lubricating fluid is churned by the rotating piston pumps due to the limited space between the piston pumps. The churning fluid results in power loss due to liquid resistance between the lubricating fluid and the surfaces of the pump barrels and pistons. The liquid resistance represents a parasitic load on the machine power source and can result in a power loss and decreased efficiency. For example, the power loss can be on the order of 0.4 kW in a 120 cc hydraulic pump.

In view of this, a need exists for an improved SBS piston pump housing assembly providing improved lubricant flow within the pump cavity with reduced parasitic power loss from churning of lubricating fluids within the housing assembly.

SUMMARY OF THE DISCLOSURE

In one aspect of the present disclosure, a housing assembly for an SBS piston pump is disclosed. The SBS piston pump has a first piston pump with a first longitudinal axis and a second piston pump having a second longitudinal axis. The housing assembly may include a first end surface, a second end surface disposed opposite the first end surface, a pump cavity surface extending from the first end surface to the second end surface and encircling the first piston pump and the second piston pump so that the first end surface, the second end surface and the pump cavity surface define a pump cavity in which the first piston pump and the second piston pump are contained. The pump cavity surface may include a first side portion and a second side portion disposed opposite the first side portion, wherein the first piston pump and the second piston pump are arranged side-by-side with the first longitudinal axis parallel to the second longitudinal axis, and the housing assembly may further include a shroud plate extending from the first side portion of the pump cavity surface toward the second side portion in a fluid intersection area between the first piston pump and the second piston pump.

In another aspect of the present disclosure, a housing assembly for an SBS piston pump is disclosed. The SBS piston pump has a first piston pump with a first longitudinal axis and a second piston pump having a second longitudinal axis. The housing assembly may include a first end surface, a second end surface disposed opposite the first end surface, a pump cavity surface extending from the first end surface to the second end surface and encircling the first piston pump and the second piston pump so that the first end surface, the second end surface and the pump cavity surface define a pump cavity in which the first piston pump and the second piston pump are contained. The pump cavity surface may include a first side portion and a second side portion disposed opposite the first side portion, wherein the first piston pump and the second piston pump are arranged side-by-side with the first longitudinal axis parallel to the second longitudinal axis, and the housing assembly may further include a curved shroud plate extending from the first side portion of the pump cavity surface between the first piston pump and the second piston pump to the second side portion of the pump cavity surface and having a first curved shroud section partially encircling the first piston pump and a second curved shroud section partially encircling the second piston pump.

In a further aspect of the present disclosure, a housing assembly for an SBS piston pump is disclosed. The SBS piston pump has a first piston pump with a first longitudinal axis and a second piston pump having a second longitudinal axis. The housing assembly may include a first end surface, a second end surface disposed opposite the first end surface, a pump cavity surface extending from the first end surface to the second end surface and encircling the first piston pump and the second piston pump so that the first end surface, the second end surface and the pump cavity surface define a pump cavity in which the first piston pump and the second piston pump are contained. The pump cavity surface may include a first side portion and a second side portion disposed opposite the first side portion, wherein the first piston pump and the second piston pump are arranged side-by-side with the first longitudinal axis parallel to the second longitudinal axis, and the housing assembly may further include a first shroud portion extending inwardly from the first side portion of the pump cavity surface toward the second side portion of the pump cavity surface in a fluid intersection area between the first piston pump and the second piston pump.

Additional aspects are defined by the claims of this patent.

DETAILED DESCRIPTION

Although the following text sets forth a detailed description of numerous different embodiments of the present disclosure, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112(f).

Figure 1:
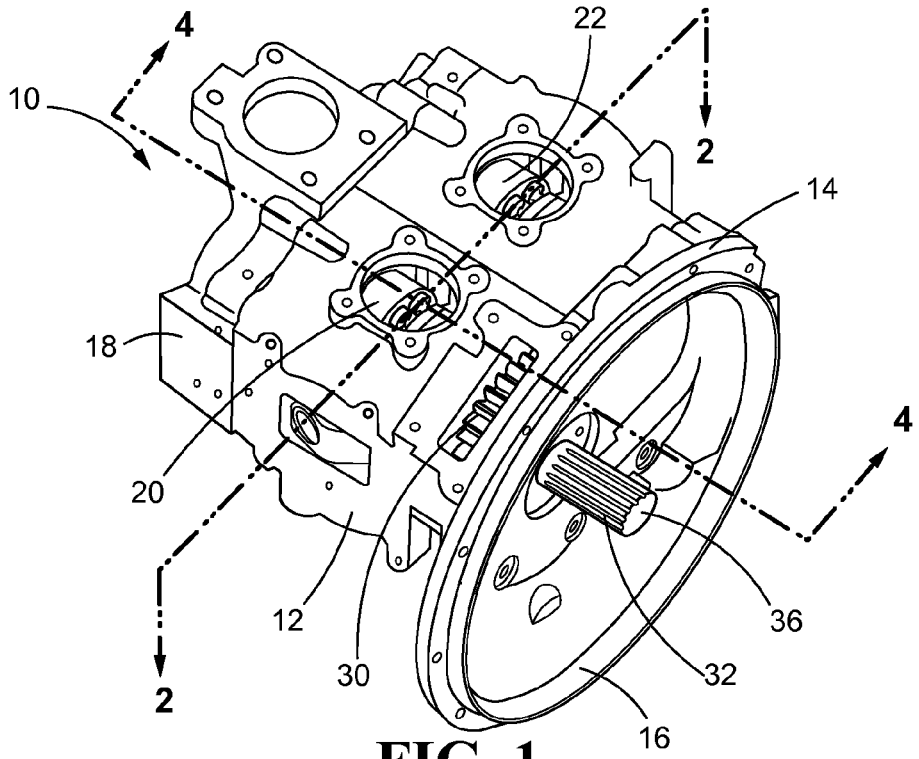
FIG. 1 is a perspective view of an SBS piston pump housing assembly in which fluid flow control in accordance with the present disclosure may be implemented.

FIG. 1 illustrates one example of an SBS piston pump housing assembly 10 in which improved lubricating fluid flow may be achieved in accordance with the present disclosure. The housing assembly 10 may have a multi-piece construction and include a main housing portion 12, a first or lower housing portion 14 with a flange 16 that may house an engine flywheel (not shown), and a second or upper housing portion or header 18. Directional terms such as "upper" and "lower" are used for reference and clarity of discussion only, and not to indicate or limit the orientation of the housing assembly 10 when installed in a particular machine. The housing portions 12, 14, 18 of the housing assembly 10 may include various openings there through to allow access and control of components within the housing assembly 10, and flow and replacement of fluids such as lubricating fluids and hydraulic fluids flowing through a first or drive piston pump 20 and a second or driven piston pump 22.

Figure 2:
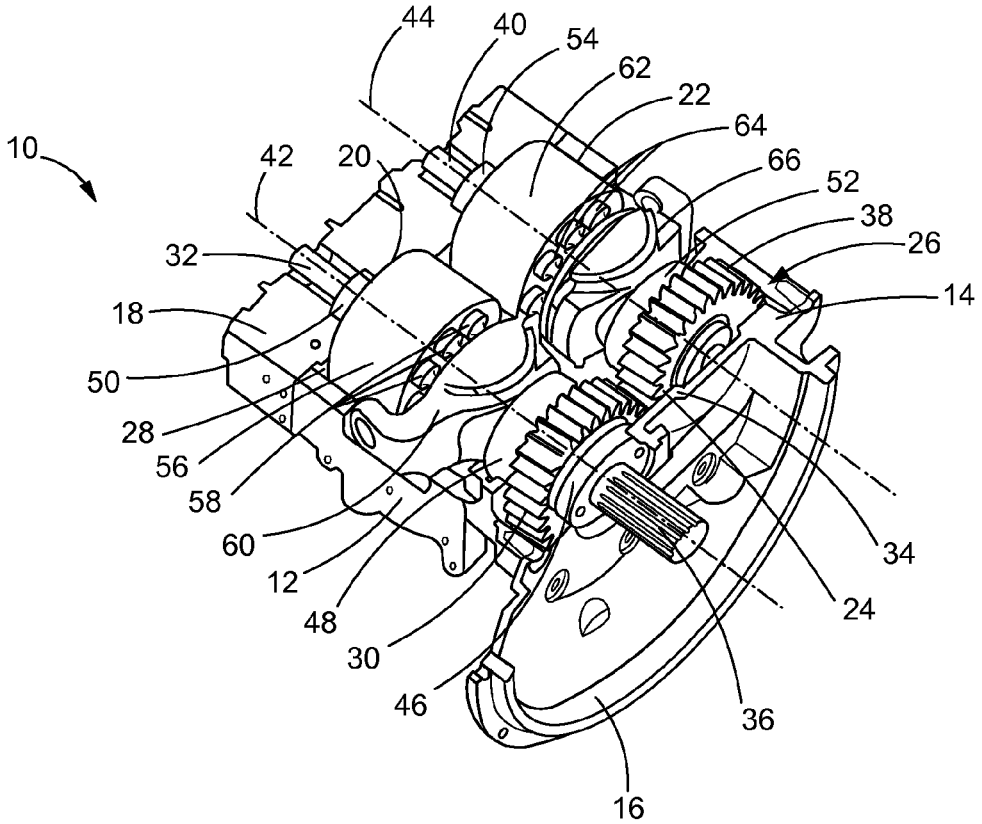
FIG. 2 is a perspective partial cross-sectional view of the SBS piston pump housing assembly of FIG. 1 taken through line 2-2 and with the housing portions shown in cross-section to reveal the internal components of the housing assembly.
Figure 3:
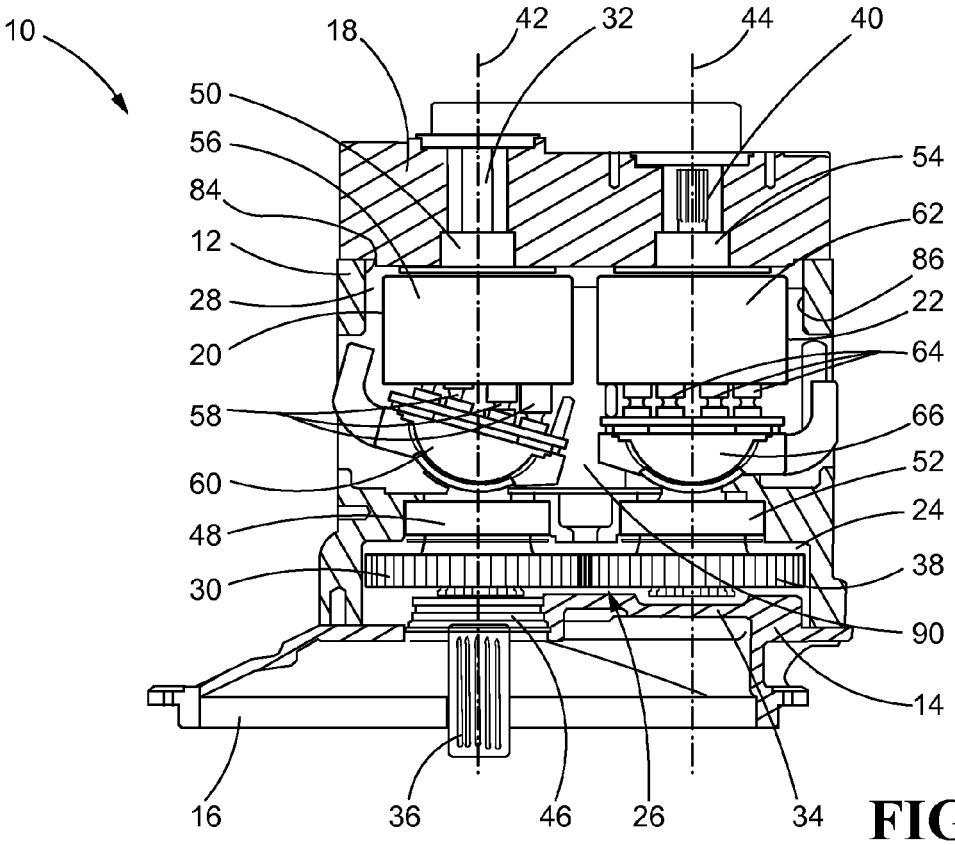
FIG. 3 is a front partial cross-sectional view of the SBS piston pump housing assembly of FIG. 1 taken through line 2-2 and with the housing portions shown in cross-section to reveal the internal components of the housing assembly.

Referring to FIGS. 1-3, the latter of which illustrate the housing portions 12, 14, 18 in cross-section to reveal the internal components of the housing assembly 10, the housing portions 12, 14, 18 define a gear cavity 24 housing a spur gear set 26 and a pump cavity 28 housing the piston pumps 20, 22. The spur gear set 26 includes a first or drive gear 30 mounted on a first or drive shaft 32 that extends through an outer or bottom wall 34 of the lower housing portion 14, and through the gear cavity 24 and the pump cavity 28. A splined end 36 of the drive shaft 32 extends outwardly from the outer wall 34 and through the flange 16 for operative coupling of the drive shaft 32 to an engine or the power source of a machine in which the housing assembly 10 is installed for rotation of the spur gear set 26 and the piston pumps 20, 22. The spur gear set 26 further includes a second or driven gear 38 mounted on a second or driven shaft 40 within the housing assembly 10 and extending through the gear cavity 24 and the pump cavity 28. A first longitudinal axis 42 of the drive shaft 32 and a second longitudinal axis 44 of the second shaft 40 are aligned parallel so that the gears 30, 38 mesh and the first gear 30 causes the second gear 38 and the second shaft 40 to rotate when the drive shaft 32 is rotated by the power source.

The drive shaft 32 is mounted for rotation in the housing assembly 10 by drive shaft bearings 46, 48, 50, and the second shaft 40 is mounted for rotation by driven shaft bearings 52, 54. The first piston pump 20 is disposed on the drive shaft 32 between the drive shaft bearings 48, 50, and includes a first pump barrel 56 mounted on the drive shaft 32 for rotation there with, and a plurality of first pump pistons 58 disposed within corresponding cylinders (not shown) of the first pump barrel 56 for reciprocal movement therein. A first adjustable swash plate 60 is mounted between the first pump barrel 56 and the drive shaft bearing 48, and is movable by a swash plate control assembly (not shown) to pivot the first adjustable swash plate 60 about an axis perpendicular to the longitudinal axis 42 to control the amount and direction of hydraulic fluid flow produced by the first piston pump 20 in a manner known in the art. As shown, the first adjustable swash plate 60 is oriented so that expansion strokes of the first pump pistons 58 occur as the first pump pistons 58 move from left to right as shown in FIG. 3, and compression strokes occur as the first pump pistons 58 move from right to left as shown. Rotating the first adjustable swash plate 60 counterclockwise to an opposite orientation will reverse the expansion and compression strokes of the first pump pistons 58 and, correspondingly, the flow of hydraulic fluid through the first piston pump 20.

Figure 4:
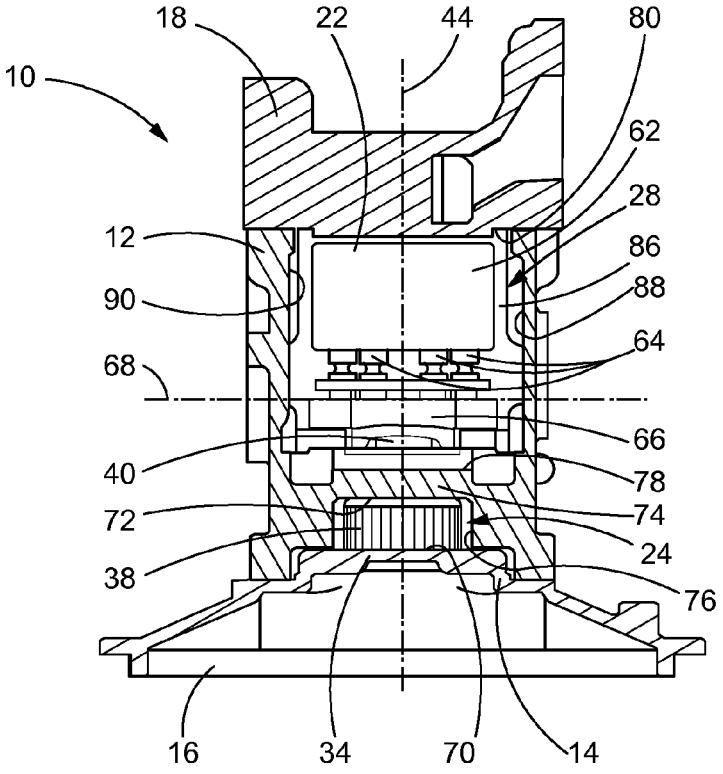
FIG. 4 is a side partial cross-sectional view of the SBS piston pump housing assembly of FIG. 1 taken through line 4-4 and with the housing portions shown in cross-section to reveal the internal components of the housing assembly.

In a similar manner, the second piston pump 22 is disposed on the second shaft 40 between the driven shaft bearings 52, 54 and includes a second pump barrel 62 mounted for rotation with the second shaft 40, a plurality of second pump pistons 64, and a second adjustable swash plate 66 controlling the flow of the hydraulic fluid through the second piston pump 22. As shown in FIG. 3 and FIG. 4, which is a side cross-sectional view showing the second piston pump 22, the second gear 38 and the second shaft 40, the second adjustable swash plate 66 is in a neutral position with a plane of the second adjustable swash plate 66 perpendicular to the longitudinal axis 44 of the second shaft 40. In this position, the second pump pistons 64 do not reciprocate as the second pump barrel 62 and the second pump pistons 64 rotate about the longitudinal axis 44, and the hydraulic fluid is not pumped by the second piston pump 22. From this position, the second adjustable swash plate 66 may be rotated in either direction about a swash plate rotation axis 68 to create flow of pressurized hydraulic fluid in the desired direction.

Figure 5:
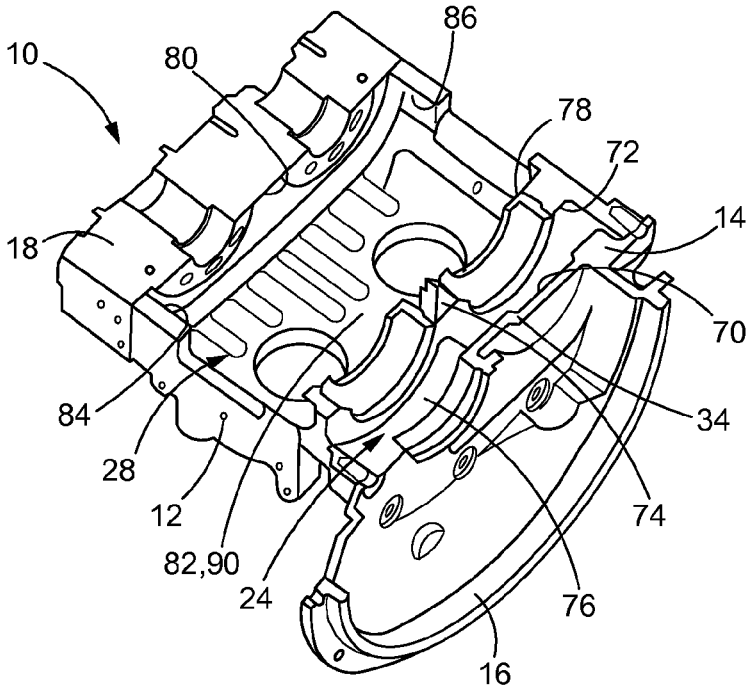
FIG. 5 is the perspective partial cross-sectional view of FIG. 2 with the internal components of the housing assembly removed to reveal the gear and pump cavities.
Figure 6:
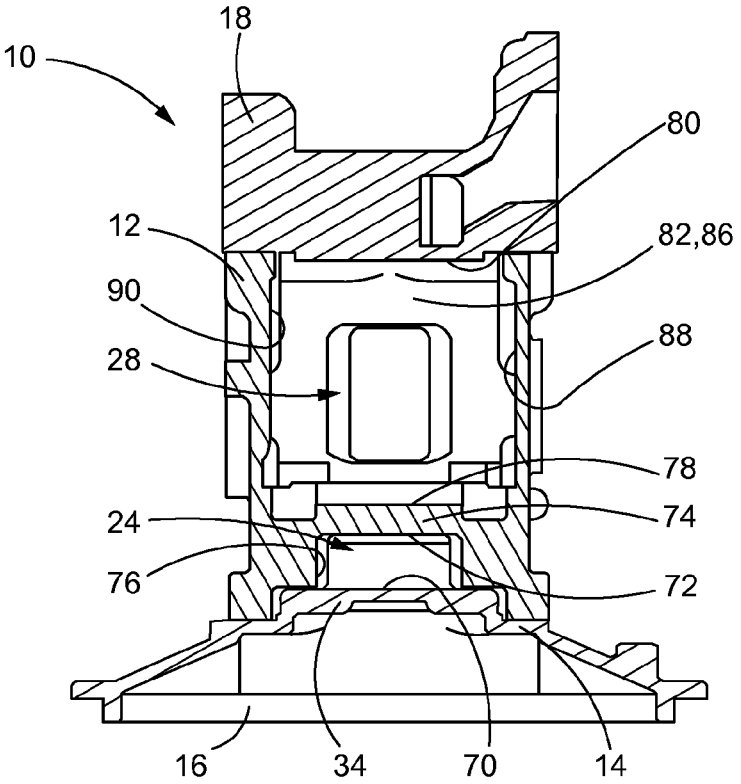
FIG. 6 is the side partial cross-sectional view of FIG. 4 with the internal components of the housing assembly removed to reveal the gear and pump cavities.

FIGS. 5 and 6 present the cross-sectional views of the housing assembly 10 with the piston pumps 20, 22, the spur gear set 26 and the shafts 32, 40 removed to show the gear cavity 24 and the pump cavity 28. The gear cavity 24 is defined by the main housing portion 12 and the lower housing portion 14, and the pump cavity 28 is defined by the main housing portion 12 and the upper housing portion 18. More particularly, the gear cavity 24 is defined by a gear cavity first end surface 70 of the bottom wall 34 of the lower housing portion 14, a gear cavity second end surface 72 of an intermediate wall 74 of the main housing portion 12, and a gear cavity surface 76 disposed between the end surfaces 70, 72 and encircling the spur gear set 26. The pump cavity 28 may be defined by a pump cavity first end surface 78 of the intermediate wall 74, a gear cavity second end surface 80 of the upper housing portion 18, and a pump cavity surface 82 of the main housing portion 12 disposed between the end surfaces 78, 80 and encircling the piston pumps 20, 22. The pump cavity surface 82 may generally follow the contours of the pump barrels 56, 62, and may include first and second rounded lateral portions 84, 86, a first or front side portion 88 (FIG. 6), and a second or rear side portion 90 (FIG. 5). As mentioned previously, the directional terms such as "top," "bottom," "lateral," "front" and "rear" are used to facilitate clarity in the present disclosure, and not to limit the manner in which the housing assembly 10 may be oriented when installed in a particular machine.

Figure 7:
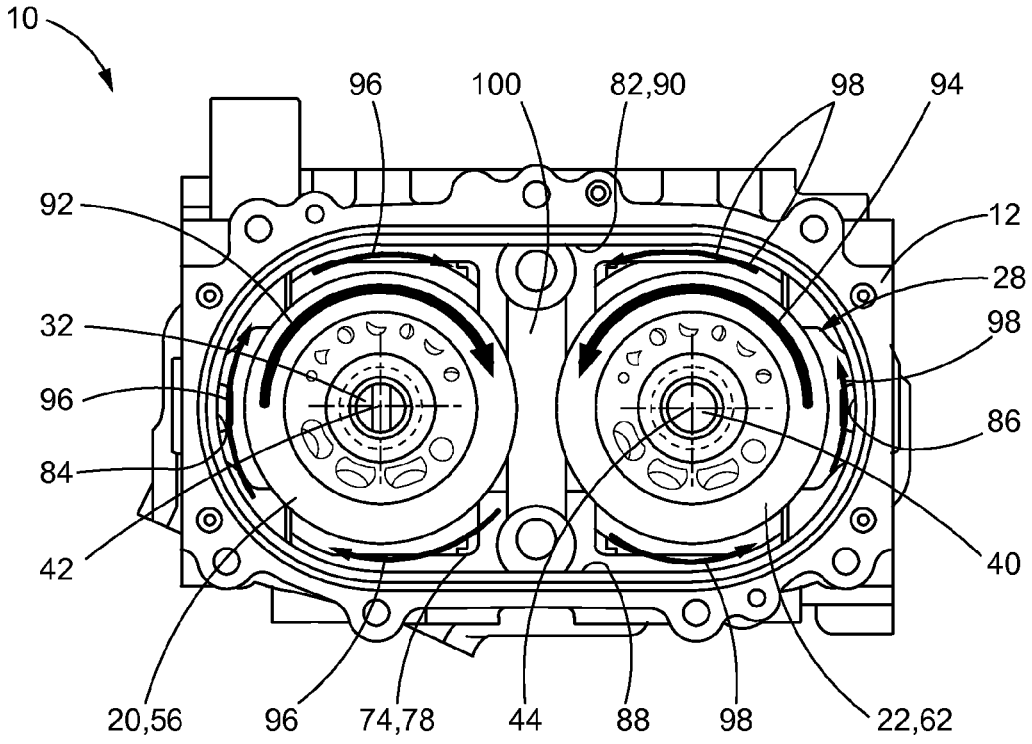
FIG. 7 is a top view of the SBS piston pump housing assembly of FIG. 1 with the upper housing portion and the flange removed.

As best seen in FIGS. 3 and 4, the distance between the pump barrels 56, 62, and the distances between the pump barrels 56, 62 and the corresponding portions of the second end surface 80 of the upper housing portion 18 and the pump cavity surface 82 are as small as practical to optimize the space occupied by the housing assembly 10 within the machine. The tight dimension in the area between the pump barrels 56, 62 can present a restriction to the flow of lubricating fluid within the pump cavity 28. As shown in FIG. 7, which is a top view of the housing assembly 10 with the upper housing portion 18 and the flange 16 removed, the piston pumps 20, 22 rotate in opposite directions when the drive shaft 32 is rotated by the power source as indicated by the arrows 92, 94, respectively. As the piston pumps 20, 22 rotate, lubricating fluid in contact with the exterior surfaces of the pump barrels 56, 62 and the pump pistons 58, 64 flows in the direction of rotation of the corresponding piston pumps 20, 22 as indicated by arrows 96, 98, respectively. The lubricating fluid experiences relatively consistent flow dynamics in the areas between the first pump barrel 56 and the first lateral portion 84, and between the second pump barrel 62 and the second lateral portion 86. However, as the lubricating fluid reaches the rear side portion 90, the distance between the piston pumps 20, 22 and the pump cavity surface 82 increases and, correspondingly, the area of the flow channel increases. In this fluid intersection area 100, flow of lubricating fluid begins to stagnate while at the same time the two fluid streams mix and are directed toward the narrowing area between the piston pumps 20, 22, which further stagnates the fluid flow and causes churning and pooling in the fluid intersection area 100. The liquid resistance of the churning and pooling lubricating fluid creates a parasitic load working against rotation of the piston pumps 20, 22 and, correspondingly, the power source of the machine turning the drive shaft 32.

Figure 8:
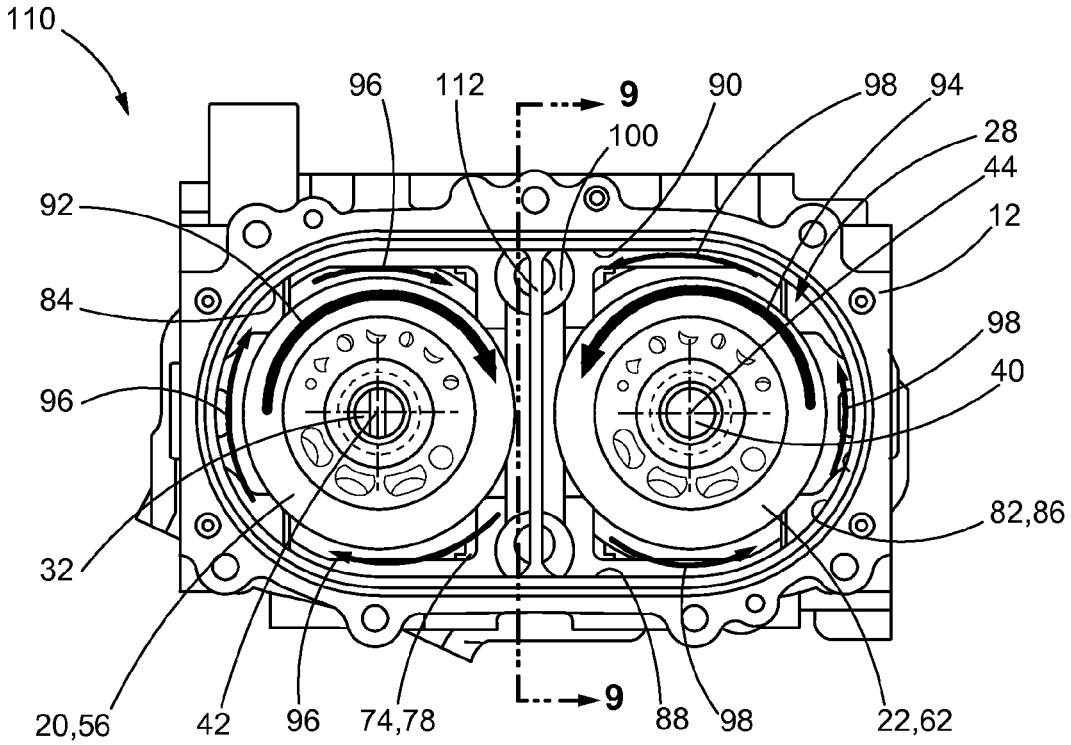
FIG. 8 is a top view of an embodiment of an SBS piston pump housing assembly with the upper housing portion and the flange removed and including a planar shroud plate in accordance with the present disclosure.

FIG. 8 illustrates an embodiment of a modified SBS piston pump housing assembly 110 in accordance with the present disclosure configured to reduce the churning and pooling of lubricating fluid, and the resulting parasitic load. In this and the following embodiments, similar components as those discussed above with respect to the housing assembly 10 are identified with the same reference numerals. The housing assembly 110 may include a generally planar shroud plate 112 extending from and secured to the front side portion 88 and the rear side portion 90 of the pump cavity surface 82 between the piston pumps 20, 22. The shroud plate 112 may be a separate component attached to the pump cavity surface 82 via an appropriate fastening mechanism, such as welding, adhesive or a press fit. Alternatively, the shroud plate 112 may be integrally formed with the main housing portion 12 at the time of fabrication.

Figure 9:
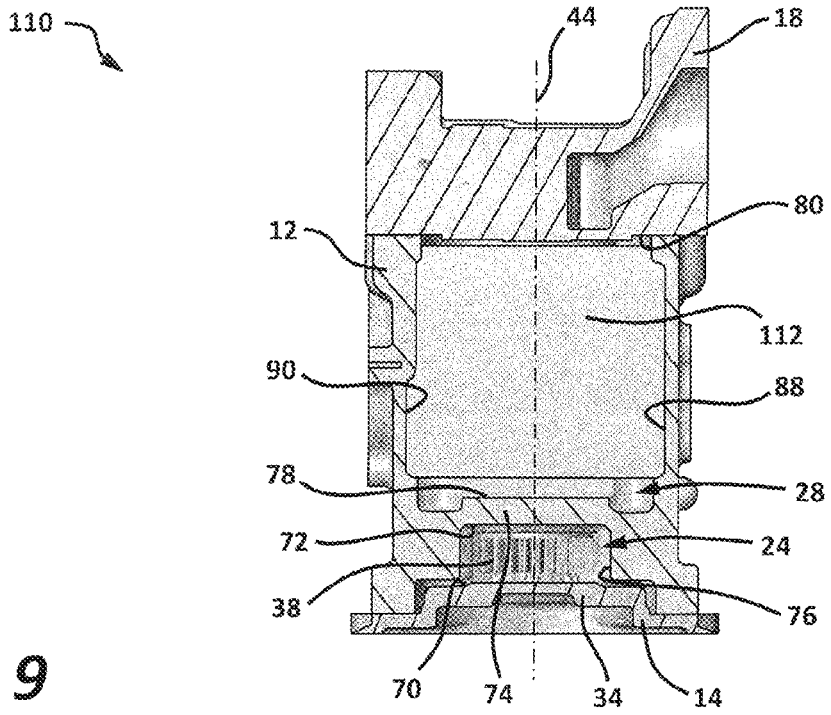
FIG. 9 is a side partial cross-sectional view of the SBS piston pump housing assembly of FIG. 8 taken through line 9-9 and with the housing portions shown in cross-section to reveal the internal components of the housing assembly.

The dimensioning of the shroud plate 112 is shown in greater detail in FIG. 9. The shroud plate 112 may have a dimension parallel to the longitudinal axes 42, 44 that is at least equal to the longitudinal length of the pump barrels 56, 62, and may be at least equal to a distance from a top end of the pump barrels 56, 62 to an opposite end of the pump pistons 58, 64 at their maximum extension during their expansion strokes. The shroud plate 112 may extend further toward the first end surface 78 of the intermediate wall 74, but not the entirely to the first end surface 78, as shown in FIG. 9. This configuration of the shroud plate 112 may allow fluid flow around the shroud plate 112 in areas that are not between the piston pumps 20, 22. Alternatively, the shroud plate 112 may extend to abut the second end surface 80 of the upper housing portion 18. As a still further embodiment, where the drive shaft 32 will only be rotated in the illustrated direction, weight and material may be conserved by having the shroud plate 112 extend from the rear side portion 90 of the pump cavity surface 82 toward the front side portion 88, but only as far as necessary to separate the converging lubricating fluid flows. Such extension may terminate before the point of minimum distance between the pump barrels 56, 62, at the point of minimum distance, or beyond the point of minimum distance as necessary to achieve the desired reduction in the parasitic loads.

The shroud plate 112 serves as a divider between the lubricating fluids flowing around the piston pumps 20, 22. The lubricating fluids flowing in opposite directions in the fluid intersection area 100 remain separated and flow between the corresponding piston pumps 20, 22 and the shroud plate 112. Without the lubricating fluid flows acting against each other, churning and stagnation in the fluid intersection area 100 are reduced, and continuity of fluid flow between the piston pumps 20, 22 is maintained.

Figure 10:
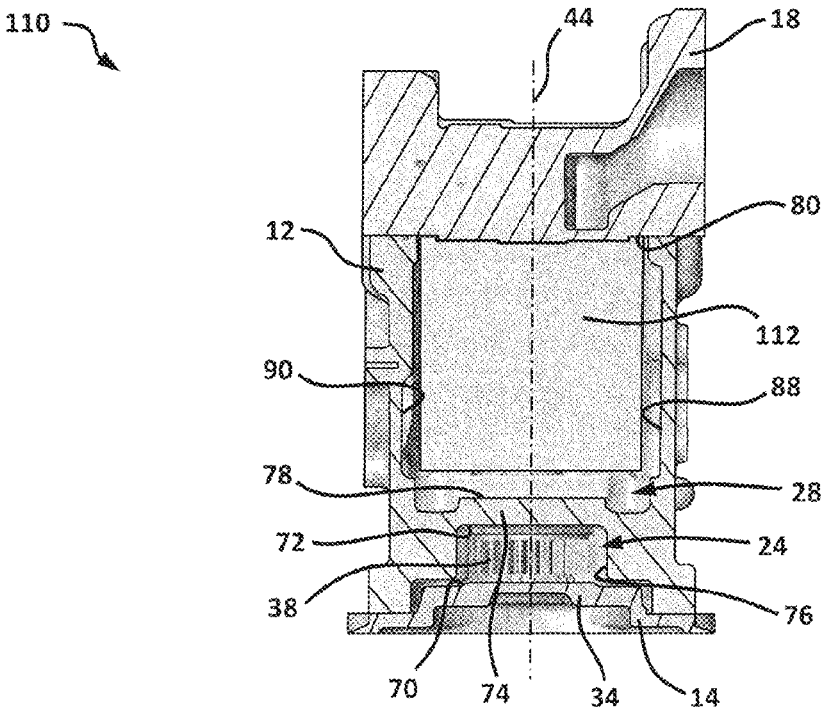
FIG. 10 is a side partial cross-sectional view of the SBS piston pump housing assembly of FIG. 8 taken through line 9-9 and with the housing portions shown in cross-section to reveal the internal components of the housing assembly, and with an alternative embodiment of the planar shroud plate.

FIG. 10 illustrates an alternative embodiment wherein the shroud plate 112 may extend from the second end surface 80 of the upper housing portion 18. In this embodiment, a width of the shroud plate 112 may be less than a distance between the front side portion 88 and the rear side portion 90 of the pump cavity surface 82. With this configuration, sufficient space for installation of the piston pumps 20, 22 may be maintained and the shroud plate 112 may be inserted into the pump cavity 28 between the pump barrels 56, 62 when the upper housing portion 18 is installed on the main housing portion 12.

Figure 11:
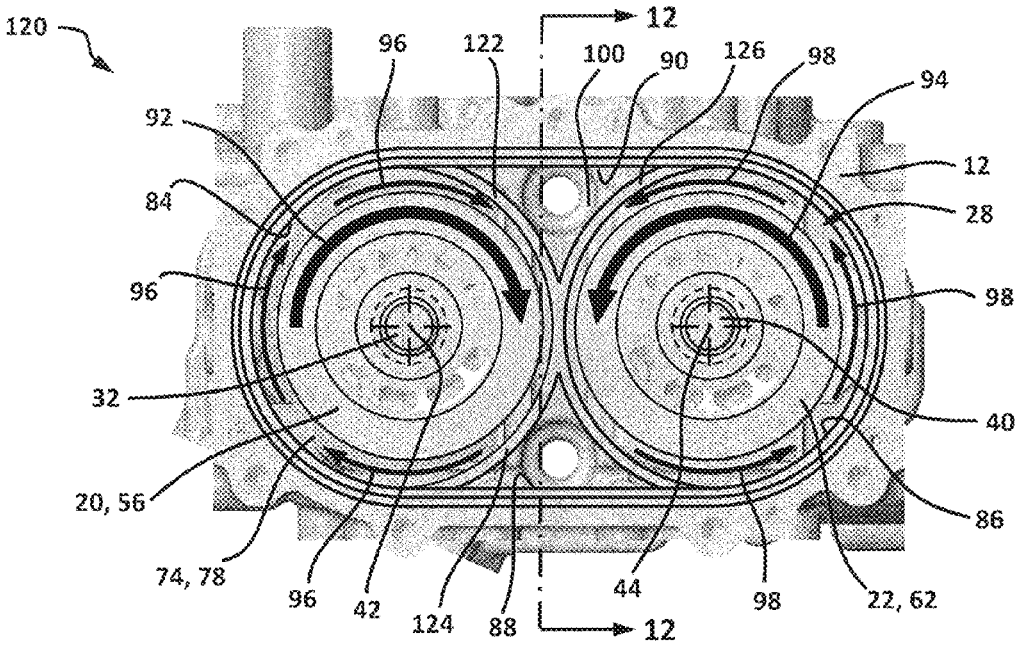
FIG. 11 is a top view of an alternative embodiment of an SBS piston pump housing assembly with the upper housing portion and the flange removed and including a curved shroud plate in accordance with the present disclosure.
Figure 12:
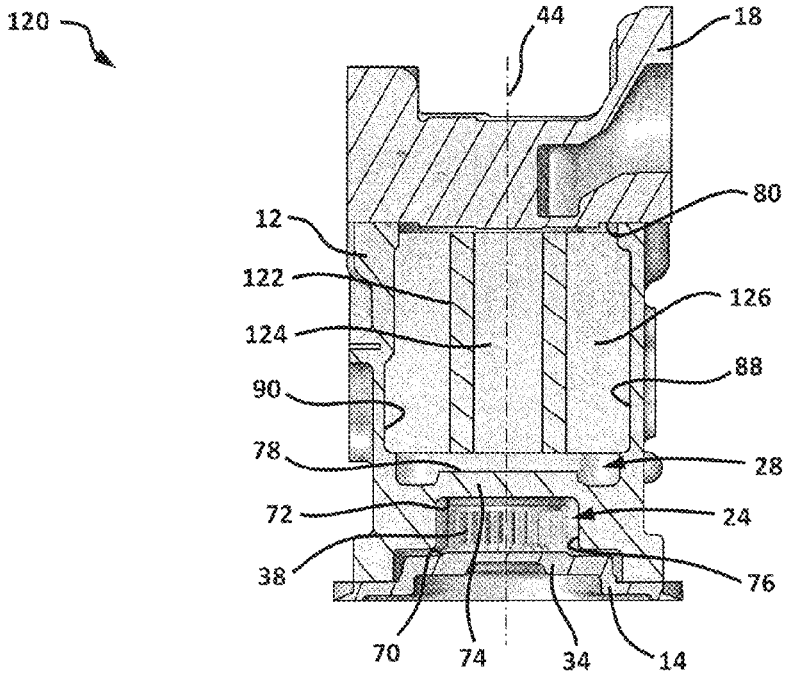
FIG. 12 is a side partial cross-sectional view of the SBS piston pump housing assembly of FIG. 11 taken through line 12-12 and with the housing portions shown in cross-section to reveal the internal components of the housing assembly.

FIGS. 11 and 12 illustrate a further alternative embodiment where an SBS piston pump housing assembly 120 includes a curved shroud plate 122 disposed within the pump cavity 28 between the piston pumps 20, 22. The curved shroud plate 122 may include a first curved shroud section 124 partially wrapping around and encircling the first pump barrel 56 and having a curved shape generally conforming to the outer surface of the pump barrel 56. Depending on the available space within the pump cavity 28, the first curved shroud section 124 may have a center of curvature that is coincident with the longitudinal axis 42 of the drive shaft 32 so that a concave inner surface of the first curved shroud section 124 maintains a constant radial distance from the outer surface of the first pump barrel 56. A second curved shroud section 126 may be similarly positioned and configured to partially wrap around and generally conform to and encircle the outer surface of the second pump barrel 62. As shown, the curved shroud sections 124, 126 are integrally formed to make the curved shroud plate 122 as a single unitary component. In alternative embodiments, the curved shroud portions 124, 126 may be formed separately and separately attached within the pump cavity 28, and may or may not be in contact with each other.

As shown in FIG. 12, the curved shroud plate 122 may have a dimension parallel to the longitudinal axes 42, 44 that is approximately equal to the longitudinal length of the pump barrels 56, 62, or may be longer and/or extend to the second end surface 80 of the upper housing portion 18 in a similar manner as discussed above for the planar shroud plate 112 if necessary to achieve a desired lubricating fluid flow. The curved shroud sections 124, 126 may be secured to the pump cavity surface 82 at corresponding positions on the front side portion 88 and the rear side portion 90, or corresponding positions on the lateral portions 84, 86. Alternatively, as with the planar shroud plate 112, the curved shroud plate 122 may extend from the second end surface 80 of the upper housing portion 18, and be inserted into the pump cavity 28 between the pump barrels 56, 62 when the upper housing portion 18 is installed in the housing assembly 120.

Similar to the planar shroud plate 112, the curved shroud plate 122 separates the lubricating fluids flowing around the piston pumps 20, 22. The curvature of the curved shroud sections 124, 126 further directs the lubricating fluids around the piston pumps 20, 22, respectively, and substantially avoids flow into the fluid intersection area 100. With this configuration, the lubricating fluids maintain a substantially continuous circuit around the outer surfaces of the piston pumps 20, 22.

Figure 13:
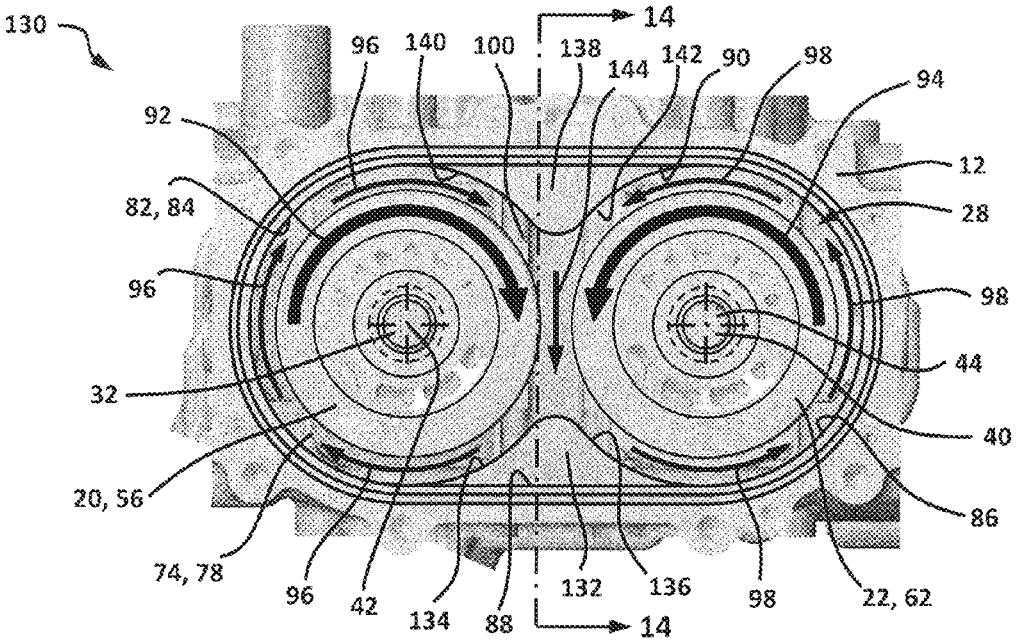
FIG. 13 is a top view of a further alternative embodiment of an SBS piston pump housing assembly with the upper housing portion and the flange removed and including first and second shroud portions of a pump cavity surface in accordance with the present disclosure.
Figure 14:
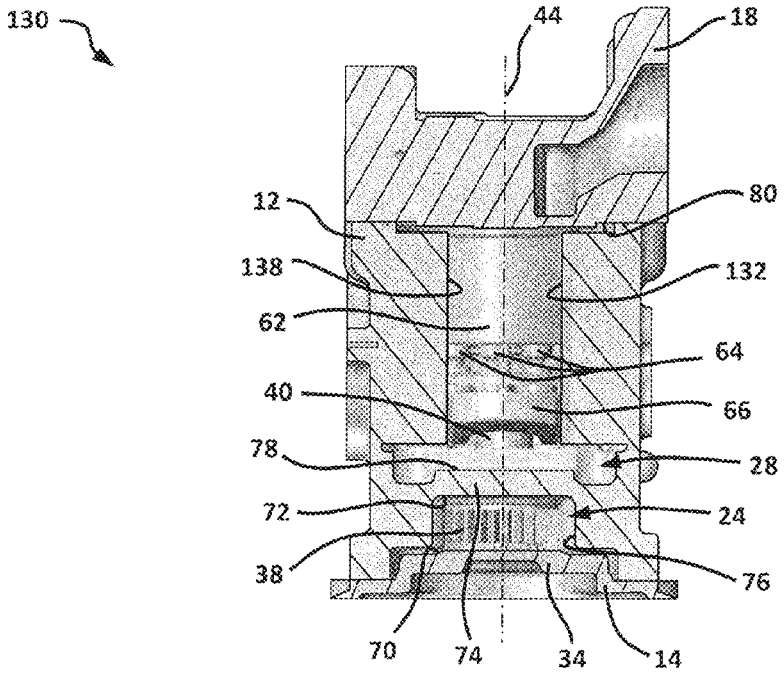
FIG. 14 is a side partial cross-sectional view of the SBS piston pump housing assembly of FIG. 13 taken through line 14-14 and with the housing portions shown in cross-section to reveal the internal components of the housing assembly.

In a still further alternative embodiment of an SBS piston pump housing assembly 130 shown in FIGS. 13 and 14, the pump cavity surface 82 may be configured in a manner that redirects the lubricating fluid flows around the piston pumps 20, 22 so that the fluid flows merge as they flow in the same or substantially the same direction between the piston pumps 20, 22. As best seen in FIG. 13, the pump cavity surface 82 may include a first shroud portion 132 extending inwardly into the pump cavity 28 at the front side portion 88 and between the piston pumps 20, 22. The first shroud portion 132 may have a first pump side 134 having a curvature that is complimentary to the curvature of the outer surface of the first pump barrel 56, and a second pump side 136 having a curvature that is complimentary to the curvature of the outer surface of the second pump barrel 62. The pump sides 134, 136 may have centers of curvature that coincide with the corresponding longitudinal axes 42, 44. The pump cavity surface 82 may further include a second shroud portion 138 extending inwardly at the rear side portion 90 between the piston pumps 20, 22 and having a first pump side 140 and a second pump side 142 having curvatures that are complimentary to the curvatures of the outer surfaces of the pump barrels 56, 62, respectively, and may have centers of curvature that are coincident with the longitudinal axes 42, 44. In alternative embodiments wherein the piston pumps 20, 22 only rotate in the directions indicated by the arrows 92, 94, the second shroud portion 138 may be omitted.

As shown in FIG. 14, the shroud portions 132, 138 may have lengths parallel to the longitudinal axes 42, 44 that are approximately equal to the longitudinal length of the piston pumps 20, 22, or may be longer and/or extend to the second end surface 80 of the upper housing portion 18 if necessary to achieve a desired lubricating fluid flow. The shroud portions 132, 138 may be secured to the pump cavity surface 82 at corresponding positions on the front side portion 88 and the rear side portion 90, respectively. Alternatively, the shroud portions 132, 138 may extend from the second end surface 80 of the upper housing portion 18, and be inserted into the pump cavity 28 when the upper housing portion 18 is installed in the housing assembly 130.

The shroud portions 132, 138 allow the lubricating fluid flows indicated by the arrows 96, 98 to merge into a combined lubricating fluid stream 144 between the piston pumps 20, 22 and then separate back into the individual fluid flows as the combined lubricating fluid stream 144 exits the area between the piston pumps 20, 22. As the lubricating fluid flows with the rotating piston pumps 20, 22, the pump sides 140, 142 of the second shroud portion 138 direct the lubricating fluid toward the area between the piston pumps 20, 22 in lieu of allowing flow into the fluid intersection area 100 proximate the rear side portion 90 of the pump cavity surface 82. The individual fluid flows eventually merge into the combined lubricating fluid stream 144 where the fluid flows are moving in approximately the same direction so that the lubricating fluid continues flowing between the piston pumps 20, 22 with substantially less pooling and churning in the fluid intersection area 100. The combined lubricating fluid stream 144 is engaged by the first shroud portion 132 as it exits the area between the piston pumps 20, 22, with a portion of the lubricating fluid being directed around the first piston pump 20 by the first pump side 134 of the first shroud portion 132, and the remainder of the lubricating fluid being directed around the second piston pump 22 by the second pump side 136.

INDUSTRIAL APPLICABILITY

The SBS piston pump housing assemblies 110, 120, 130 incorporating the flow control features described herein may be used with any suitable housing where side-by-side piston pumps submerged in lubricating fluid are used to generate flow of pressurized hydraulic fluid, especially where churning losses are present. By separating the flows of lubricating fluid around the piston pumps 20, 22, or directing the flows so that the flows merge when they are moving in the same or similar directions, pooling and churning of the lubricating fluid may be significantly reduced or virtually eliminated. The pooling and churning reductions result in corresponding reductions in fluid resistance of the lubricating fluid and the attendant parasitic loads that reduce the efficiency of the SBS piston pump assembly and the power source of the machine.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A housing assembly for a side-by-side (SBS) piston pump having a first piston pump with a first cylindrical pump barrel and a first longitudinal axis and a second piston pump having a second cylindrical pump barrel and a second longitudinal axis, the housing assembly comprising:

a first end surface;

a second end surface disposed opposite the first end surface;

a pump cavity surface extending from the first end surface to the second end surface and encircling the first piston pump and the second piston pump so that the first end surface, the second end surface and the pump cavity surface define a pump cavity in which the first piston pump and the second piston pump are contained, wherein the pump cavity surface includes a first side portion and a second side portion disposed opposite the first side portion, and wherein the first piston pump and the second piston pump are arranged side-by-side with the first longitudinal axis parallel to the second longitudinal axis; and a shroud plate extending from the first side portion of the pump cavity surface toward the second side portion in a fluid intersection area between the first piston pump and the second piston pump, wherein the shroud plate has a plate length parallel to the first longitudinal axis and the second longitudinal axis that is at least equal to a longitudinal length of the first pump barrel and the second pump barrel and the shroud plate is positioned between the first cylindrical pump barrel and the second cylindrical pump barrel so that the shroud plate extends at least to a first barrel end of the first cylindrical pump barrel and the second cylindrical pump barrel that is closest to the first end surface and at least to a second barrel end of the first cylindrical pump barrel and the second cylindrical pump barrel that is closest to the second end surface, and wherein the shroud plate allows fluid flow around the shroud plate in areas within the pump cavity that are not between the first cylindrical pump barrel and the second cylindrical pump barrel.

2. The housing assembly of claim 1, wherein the shroud plate extends toward the second side portion past a location where a distance between the first piston pump and the second piston pump is a minimum distance.

3. The housing assembly of claim 1, wherein the shroud plate is connected to the first side portion of the pump cavity surface and extends between the first piston pump and the second piston pump to the second side portion and is connected to the second side portion.

4. The housing assembly of claim 1, wherein the shroud plate is connected to the first end surface and extends between the first piston pump and the second piston pump toward the second end surface.

5. The housing assembly of claim 4, wherein the shroud plate extends from the first end surface to the second end surface.

6. The housing assembly of claim 1, wherein each of the first piston pump and the second piston pump comprises a plurality of pistons reciprocating longitudinally within corresponding cylinders through the second barrel end of the first cylindrical pump barrel and the second cylindrical pump barrel, respectively.

7. The housing assembly of claim 6, wherein the plate length is at least equal to a pump maximum longitudinal length that is equal to a distance from the first barrel end of the first cylindrical pump barrel and the second cylindrical pump barrel to an end of one of the pistons extending from the second barrel end of the first cylindrical pump barrel and the second cylindrical pump barrel when the one of the pistons is in a maximum position in an expansion stroke.

8. A housing assembly for a side-by-side (SBS) piston pump having a first piston pump with a first cylindrical pump barrel and a first longitudinal axis and a second piston pump having a second cylindrical pump barrel and a second longitudinal axis, the housing assembly comprising:

a first end surface;

a second end surface disposed opposite the first end surface;

a pump cavity surface extending from the first end surface to the second end surface and encircling the first piston pump and the second piston pump so that the first end surface, the second end surface and the pump cavity surface define a pump cavity in which the first piston pump and the second piston pump are contained, wherein the pump cavity surface includes a first side portion and a second side portion disposed opposite the first side portion, and wherein the first piston pump and the second piston pump are arranged side-by-side with the first longitudinal axis parallel to the second longitudinal axis; and a curved shroud plate extending from the first side portion of the pump cavity surface between the first piston pump and the second piston pump to the second side portion of the pump cavity surface and having a first curved shroud section partially encircling the first cylindrical pump barrel and a second curved shroud section partially encircling the second cylindrical pump barrel, wherein the curved shroud plate has a plate length parallel to the first longitudinal axis and the second longitudinal axis that is at least equal to a longitudinal length of the first pump barrel and the second pump barrel and the curved shroud plate is positioned between the first cylindrical pump barrel and the second cylindrical pump barrel so that the curved shroud plate extends at least to a first barrel end of the first cylindrical pump barrel and the second cylindrical pump barrel that is closest to the first end surface and at least to a second barrel end of the first cylindrical pump barrel and the second cylindrical pump barrel that is closest to the second end surface, and wherein the curved shroud plate allows fluid flow around the shroud plate in areas within the pump cavity that are not between the first cylindrical pump barrel and the second cylindrical pump barrel.

9. The housing assembly of claim 8, wherein the curved shroud plate is connected to the first side portion and the second side portion.

10. The housing assembly of claim 8, wherein the curved shroud plate is connected to the first end surface and extends between the first piston pump and the second piston pump toward the second end surface.

11. The housing assembly of claim 8, wherein each of the first piston pump and the second piston pump comprises a plurality of pistons reciprocating longitudinally within corresponding cylinders through the second barrel end of the first cylindrical pump barrel and the second cylindrical pump barrel, respectively.

12. The housing assembly of claim 11, wherein the plate length is at least equal to a pump maximum longitudinal length that is equal to a distance from the first barrel end of the first cylindrical pump barrel and the second cylindrical pump barrel to an end of one of the pistons extending from the second barrel end of the first cylindrical pump barrel and the second cylindrical pump barrel when the one of the pistons is in a maximum position in an expansion stroke.

13. The housing assembly of claim 8, wherein the first curved shroud section has a first center of curvature that is coincident with the first longitudinal axis and the second curved shroud section has a second center of curvature that is coincident with the second longitudinal axis.

14. The housing assembly of claim 8, wherein the first curved shroud section and the second curved shroud section are integrally formed as a single unitary component.

15. A housing assembly for a side-by-side (SBS) piston pump having a first piston pump with a first cylindrical pump barrel and a first longitudinal axis and a second piston pump having a second cylindrical pump barrel and a second longitudinal axis, the housing assembly comprising:

a first end surface;

a second end surface disposed opposite the first end surface;

a pump cavity surface extending from the first end surface to the second end surface and encircling the first piston pump and the second piston pump so that the first end surface, the second end surface and the pump cavity surface define a pump cavity in which the first piston pump and the second piston pump are contained, wherein the pump cavity surface includes a first side portion and a second side portion disposed opposite the first side portion, and wherein the first piston pump and the second piston pump are arranged side-by-side with the first longitudinal axis parallel to the second longitudinal axis; and a first shroud portion extending inwardly from the first side portion of the pump cavity surface toward the second side portion of the pump cavity surface in a fluid intersection area between the first piston pump and the second piston pump, wherein the first shroud portion has a shroud length parallel to the first longitudinal axis and the second longitudinal axis that is at least equal to a longitudinal length of the first pump barrel and the second pump barrel and the first shroud portion is positioned between the first cylindrical pump barrel and the second cylindrical pump barrel so that the first shroud portion extends at least to a first barrel end of the first cylindrical pump barrel and the second cylindrical pump barrel that is closest to the first end surface and at least to a second barrel end of the first cylindrical pump barrel and the second cylindrical pump barrel that is closest to the second end surface, and wherein the first shroud portion allows fluid flow around the first shroud portion in areas within the pump cavity that are not between the first cylindrical pump barrel and the second cylindrical pump barrel.

16. The housing assembly of claim 15, comprising a second shroud portion extending inwardly from the second side portion of the pump cavity surface toward the first side portion of the pump cavity surface between the first piston pump and the second piston pump.

17. The housing assembly of claim 15, wherein the first shroud portion comprises a first pump side facing the first piston pump and a second pump side facing the second piston pump.

18. The housing assembly of claim 17, wherein the first pump side has a first center of curvature that is coincident with the first longitudinal axis and the second pump side has a second center of curvature that is coincident with the second longitudinal axis.

19. The housing assembly of claim 15, wherein the first shroud portion is connected to the first side portion of the pump cavity surface.

20. The housing assembly of claim 15, wherein each of the first piston pump and the second piston pump comprises a plurality of pistons reciprocating longitudinally within corresponding cylinders through the second barrel end of the first cylindrical pump barrel and the second cylindrical pump barrel, respectively.

* * * * *